US009027438B1

(12) United States Patent
Thomas et al.

(10) Patent No.: US 9,027,438 B1
(45) Date of Patent: May 12, 2015

(54) FABRICATED ECCENTRIC FOR DRAG LINE EXCAVATOR WALKING MECHANISMS

(75) Inventors: Maurice Wayne Thomas, Hallsville, TX (US); James Alan Ehret, Norwalk, OH (US)

(73) Assignee: Warfab Industries, Inc., Hallsville, TX (US)

( * ) Notice: Subject to any disclaimer, the term of this patent is extended or adjusted under 35 U.S.C. 154(b) by 479 days.

(21) Appl. No.: 13/447,637

(22) Filed: Apr. 16, 2012

Related U.S. Application Data

(60) Provisional application No. 61/517,337, filed on Apr. 18, 2011.

(51) Int. Cl.
*G05G 3/00* (2006.01)
*E02F 9/04* (2006.01)

(52) U.S. Cl.
CPC ..... *E02F 9/04* (2013.01)

(58) Field of Classification Search
CPC ..... F16F 15/34; B62D 57/02; E02F 9/04
USPC ..... 74/567, 569, 570.1; 180/8.1–8.7; 37/394
See application file for complete search history.

(56) References Cited

U.S. PATENT DOCUMENTS

| | | | | |
|---|---|---|---|---|
| 3,265,145 | A * | 8/1966 | Beitzel | 180/8.5 |
| 3,500,945 | A | 3/1970 | Barden et al. | |
| 3,901,341 | A | 8/1975 | Stoldt | |
| 4,252,204 | A * | 2/1981 | Bishop | 180/8.5 |
| 5,245,882 | A * | 9/1993 | Kallenberger et al. | 74/405 |
| 5,600,905 | A * | 2/1997 | Kallenberger et al. | 37/394 |
| 5,603,174 | A | 2/1997 | Kallenberger et al. | |
| 6,067,734 | A * | 5/2000 | Kallenberger | 37/395 |

* cited by examiner

*Primary Examiner* — Thomas R. Hannon
*Assistant Examiner* — Adam D Rogers
(74) *Attorney, Agent, or Firm* — Harpman & Harpman

(57) ABSTRACT

An improved eccentric used in walking mechanism sub-assemblies used in heavy equipment, specifically drag line excavators. The walking assemblies include a power driven output shaft which engages and rotates an eccentric fitting journaled within a leg housing which is in turn pivotally secured to the walking assembly shoes and through a support linkage to the excavator frame imparting a modified elliptical travel path thereto. The improvement is directed to the eccentric which is of a multiple component fabrication for increased performance and use durability and extended life.

11 Claims, 7 Drawing Sheets

FABRICATED ECCENTRIC FOR DRAG LINE EXCAVATOR WALKING MECHANISMS

This application claims the benefit of U.S. Provisional Application Ser. No. 61/517,337, filed on Apr. 18, 2011.

BACKGROUND OF THE INVENTION

1. Technical Field

This invention relates to large eccentric fittings that are used on walking mechanisms of drag line excavators which are used to move the immense size and weight of the current excavators in use.

2. Description of Prior Art

Prior art eccentrics of this type are typically cast given the nature of the load forces at work in moving modern massive drag line excavators by using a walking mechanism in which a pair of parallel spaced support shoe assemblies selectively and cyclically support the excavator as it is raised and moved forward incrementally. Improved drag line walking mechanisms can be seen for example in U.S. Pat. Nos. 3,500,945, 3,901,341 and 5,603,174.

U.S. Pat. No. 3,500,945 discloses a walking mechanism assembly with a walking crank with inboard and outboard support using an eccentrically board walking arm.

U.S. Pat. No. 3,901,341 claims a tractor mechanism for a walking drag line excavator with moving feet by radial disk cam and crank engagement of each respective foot.

U.S. Pat. No. 5,603,174 is directed to an improved walking mechanism for a drag line excavator in which a transmission output shaft drives an eccentric within the walking leg housing.

SUMMARY OF THE INVENTION

A component fabricated propel eccentric for use in drag line excavator walking mechanisms. Heretofore such large load bearing eccentrics were of a cast configuration which imparted a number of structural inherent design performance limitations. Such cast eccentric designs required a number of openings to provide for a casting process which by definition entrains inherent stressed fracture areas limiting useful service life. The improved component fabricated eccentric of the invention overcomes key failure areas of the prior art cast eccentric's web plate and barrel radius cracking typically incurred during use. By using an inner component construction of a forged hub and welded web and leg bearing support elements a load stress superior eccentric is created.

DETAILED DESCRIPTION OF THE INVENTION

Figure 1:
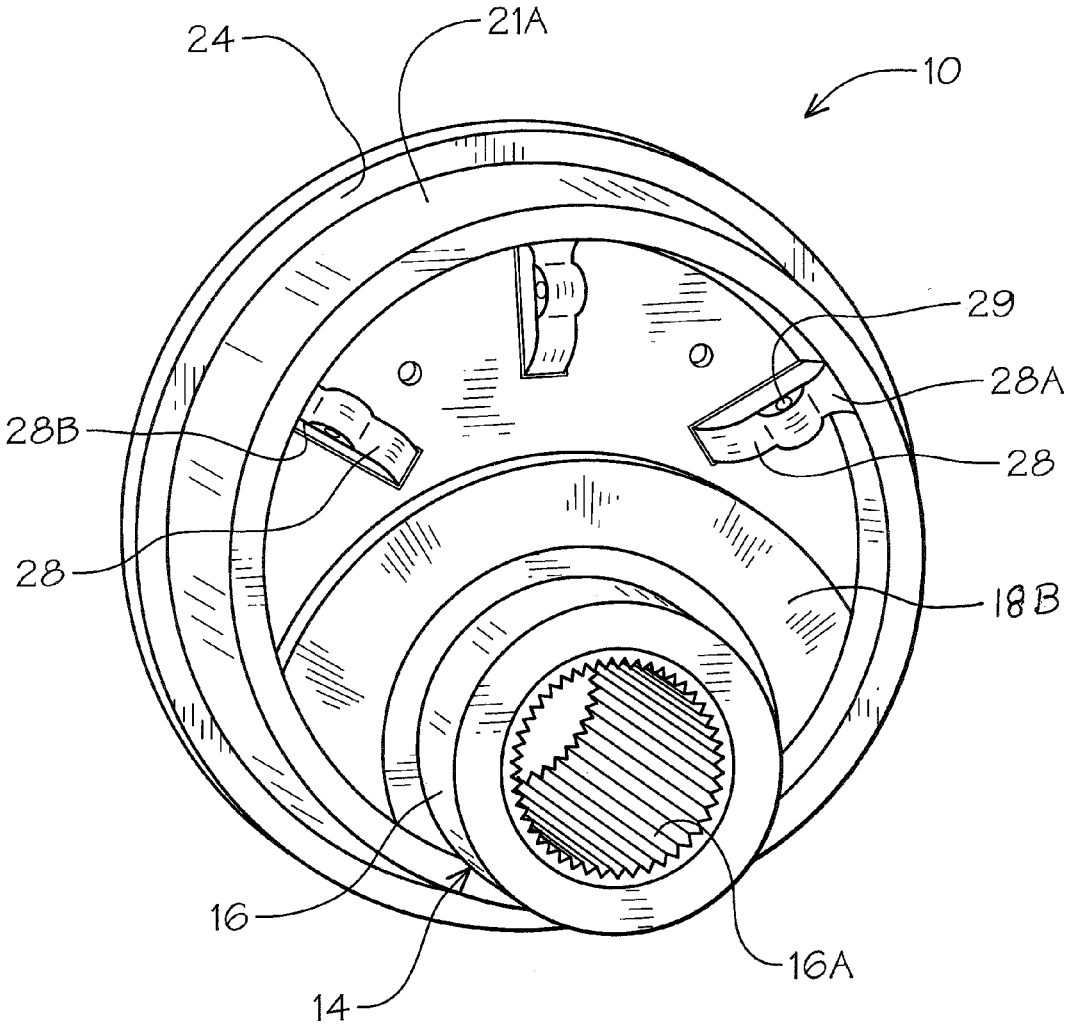
FIG. 1 is a perspective view of the fabricated eccentric of the invention.
Figure 2:
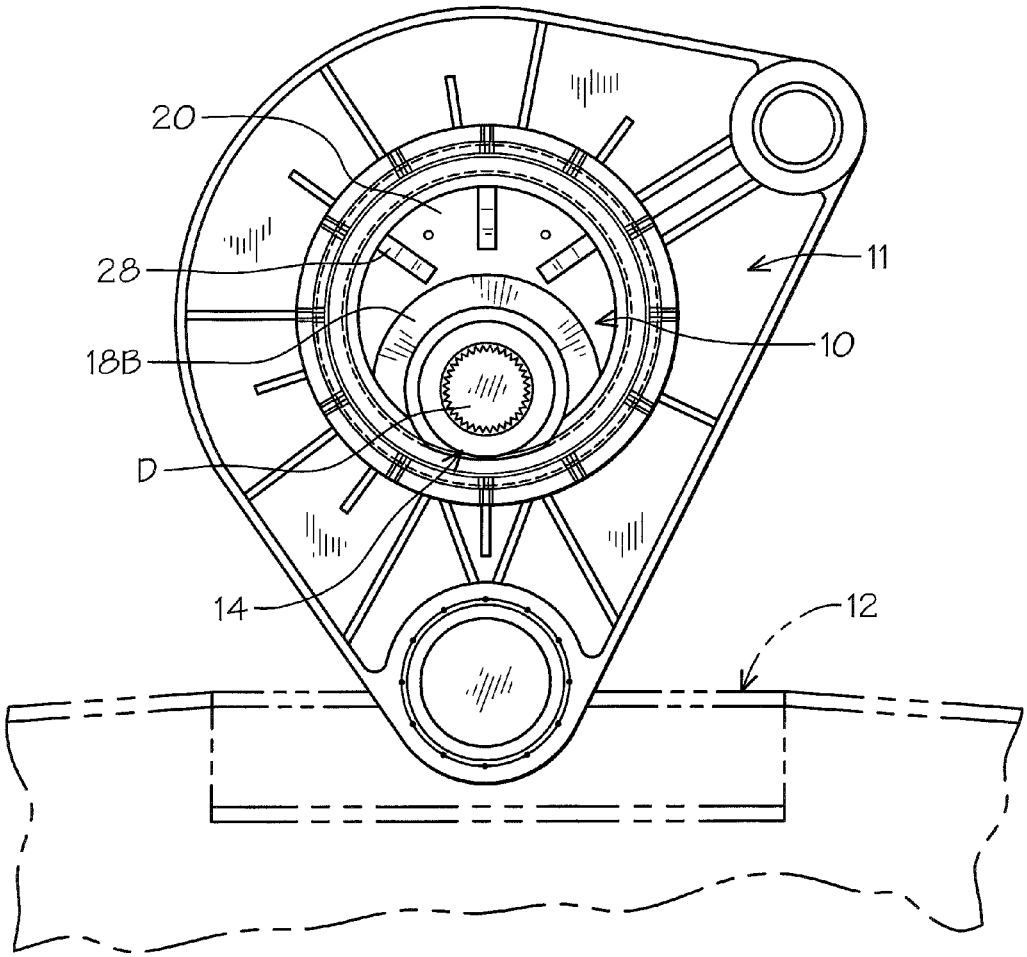
FIG. 2 is a front elevational view of a walking mechanism drive support leg with the eccentric of the invention positioned within.
Figure 10:
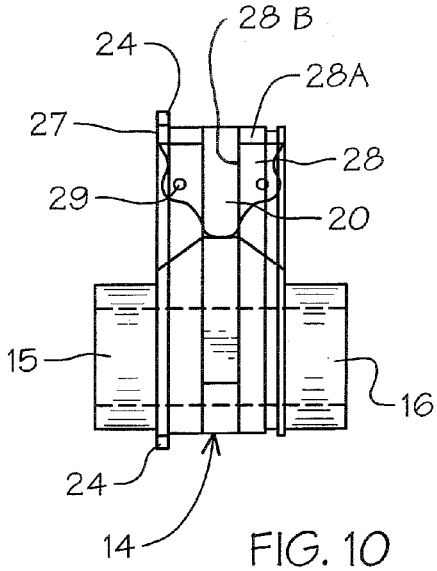
FIG. 10 is a right side elevational view thereof.

An eccentric 10 for use in a walking mechanism on a drag line excavator can be seen in FIGS. 1, 2 and 10 of the drawings. The walking mechanism uses a motor and gear reduction assembly (not shown) to rotate a drive shaft D that in turn drives the eccentric 10 of the invention, as seen in FIG. 2 of the drawings. Rotation of the eccentric 10 within a walking leg housing 11 imparts a modified elliptical walking step plot path to a pivotally attached support foot 12 shown partially in broken lines in the walking mechanism imparting a sequence of "step" alternately lifting and laterally moving and placing a pair of support feet 12 together then lifting and moving the excavator, not shown, in a repeating fashion as is well known within the drag line excavator industry as the only reliable mechanism for moving such large equipment.

Figure 3:
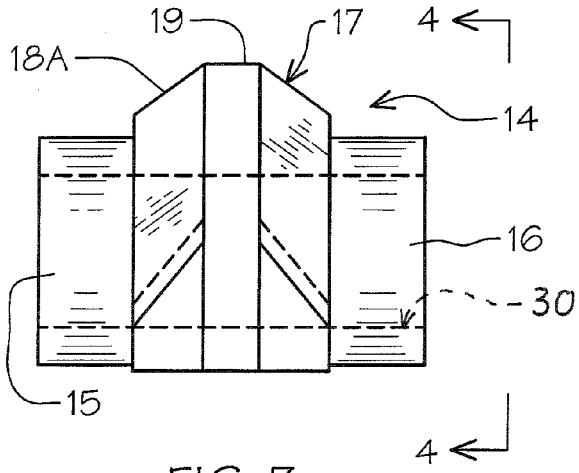
FIG. 3 is a front elevational view of a forged hub of the fabrication.
Figure 4:
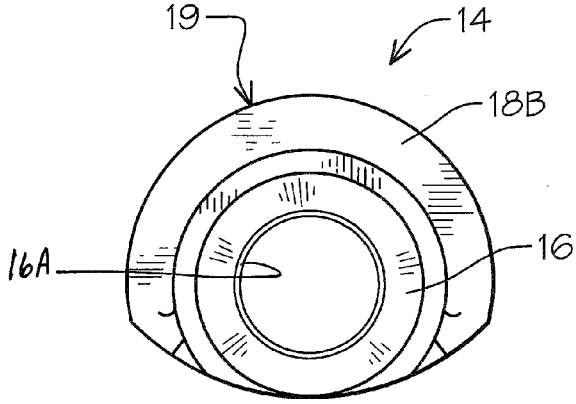
FIG. 4 is a side elevational view thereof on lines 4-4 of FIG. 3.
Figure 5:
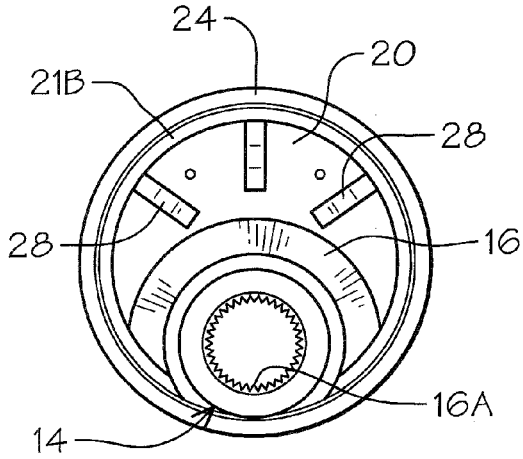
FIG. 5 is a front elevational view of the fabricated eccentric of the invention.
Figure 6:
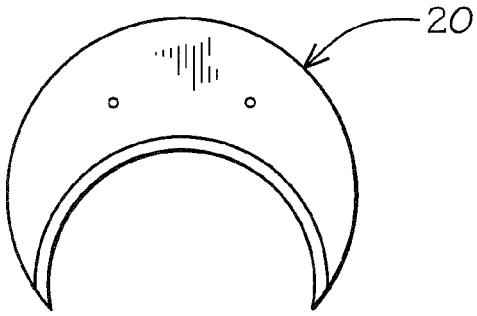
FIG. 6 is a front elevational view of the fabricated support web portion broken away.
Figure 7:
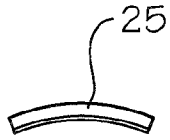
FIG. 7 is a front elevational view of an upstanding flange fabricated section for the fabrication assembly broken away.

The eccentric 10 is of a fabricated configuration from multiple component elements having a central forged hub fitting 14 as best seen in FIGS. 3 and 4 of the drawings. The forged hub fitting 14 has a pair of oppositely disposed spaced cylindrical lugs 15 and 16 with splines 16A machined therewithin. The lugs 15 and 16 extending from an elliptically shaped main body member 17 having arcuate tapered surfaces 18A and 18B defining a primary web attachment surface 19 therebetween.

Figure 11:
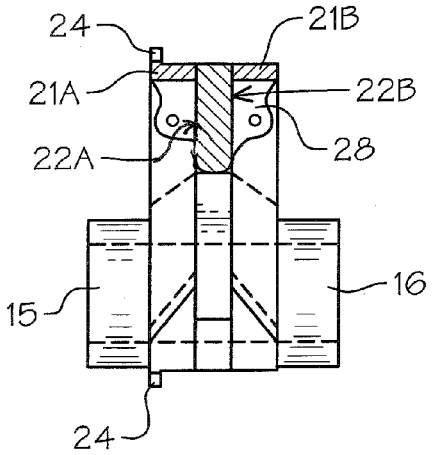
FIG. 11 is a left side elevational view of the fabricated eccentric before machining.

A fabricated web portion 20, cut from twelve inch plate material in a generally crescent shape is welded to the corresponding primary welding attachment surface 19 defining a central support element of the eccentric 10 as seen in FIG. 11 of the drawings.

Figure 8:
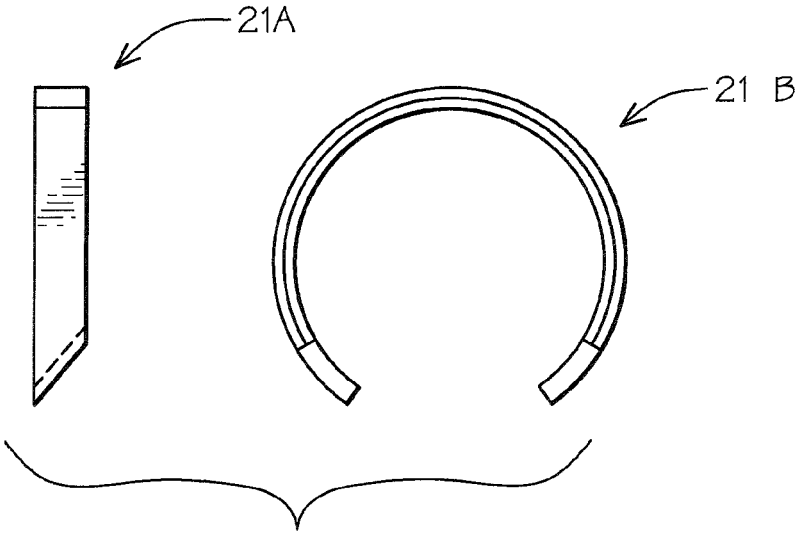
FIG. 8 is a front, end and composite elevational view of an open circular flange fabrication for the assembly broken away.

Next, a pair of fabricated flange elements 21A and 21B, best seen in FIG. 8 of the drawings are formed from six inch thick plate steel material and are of an open circle configuration for aligned opposing welding onto the respective web surfaces 22A and 22B of the web portion 20 inwardly from its perimeter edge 23 extending at ninety degrees from the web portion 20 as seen in FIG. 11 of the drawings.

An upstanding flange 24 on the respective flange element 21A is fabricated from a plurality of curved elements 25 each formed from four and a half inch thick plate and are sequentially welded in end to end alignment about and on the outer surface 26 of the flange element 21A inwardly from its corresponding perimeter edge 27. The multiple welded curved elements 25 extend onto respective weld fillet transitions to the hub surface areas 26A and 26B and over and onto the bottom hub surface 27 adjoining to one another to form the annularly upstanding flange 24 as seen best in FIGS. 1, 11 and 12 of the drawings.

Figure 9:
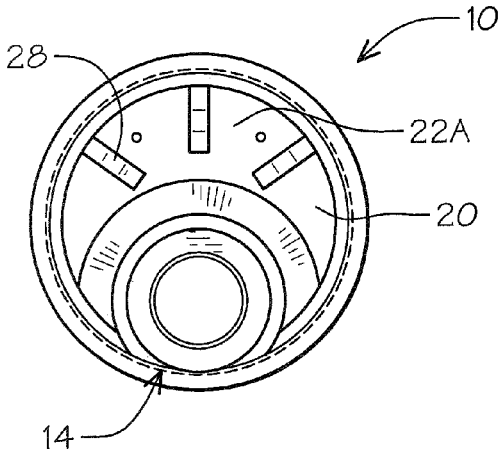
FIG. 9 is a front elevational view of the completed fabricated eccentric after stress relief and machining.
Figure 12:
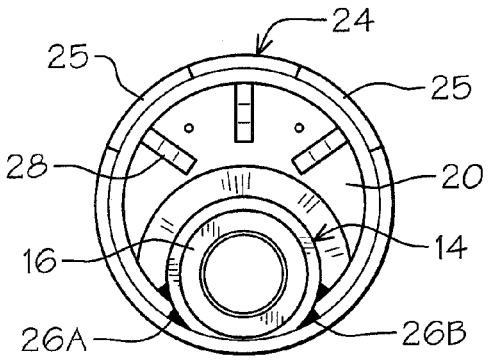
FIG. 12 is a front elevational view of the fabricated eccentric before machining.

Multiple support reinforcement brackets 28 are illustrated in FIGS. 1, 9 and 10 of the drawings are fabricated from six inch thick steel plate with right angularly flat engagement surfaces 28A and 28B in a transverse aperture at 29 therewithin. The reinforcement brackets 28 are weldably secured on the opposing web 20 surfaces 22A and 22B against and to the respective flange elements 21A and 21B in an oppositely and opposing paired radial pattern as seen in FIGS. 9 and 12 of the drawings.

A drive shaft receiving bore 30 extends through the forged hub and cylinder lugs 15 and 16 with a plurality of spline teeth 16A machined within a portion 32 of the hub board 30 inwardly from its open end 33 of the lug 16 as seen clearly in FIGS. 1 and 2 of the drawings.

After completion of the welded eccentric fabrication, final machining is applied for exterior surface use compliance as seen best in FIG. 10 of the drawings as well as weld stress relief for industry standards for fabricated components by acceptable methods such as heating the welded structure in a furnace to uniform temperature or mechanical peeling of the welds before weld cool down by well known processes.

Figure 13:
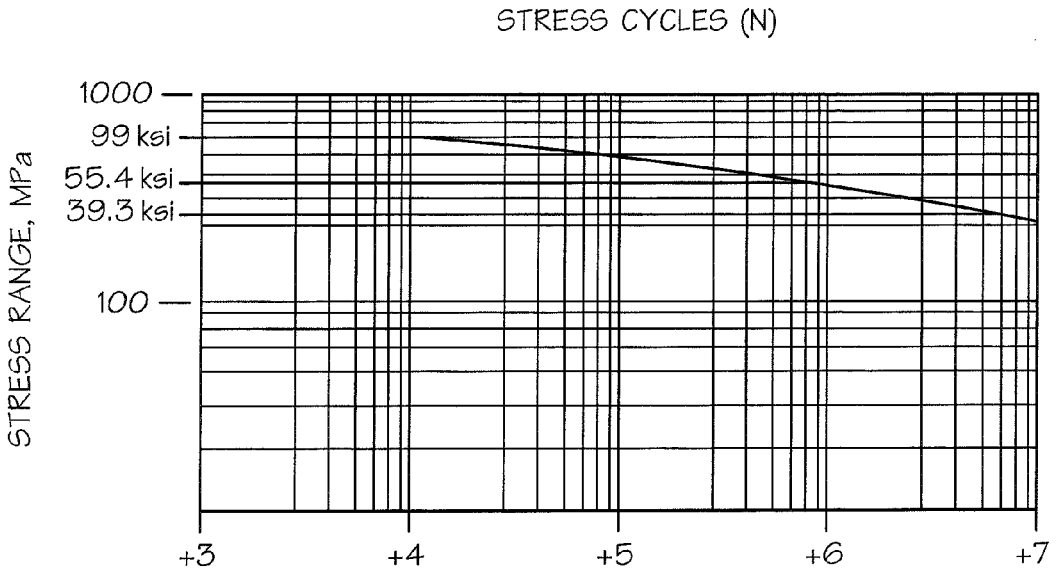
FIG. 13 is a stress cycle to stress range graph for the fabricated eccentric of the invention.
Figure 14:
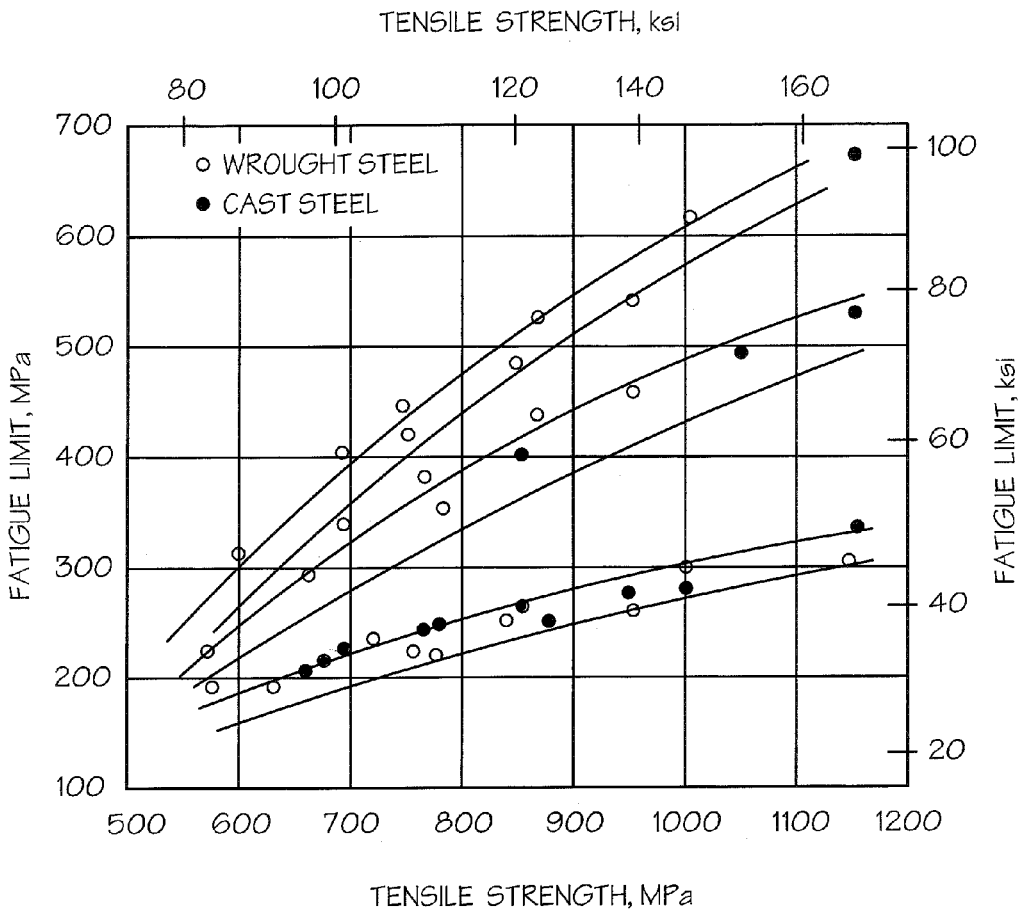
FIG. 14 is a comparison tensile strength graph between a cast eccentric and the fabricated eccentric of the invention.

The goal of the fabricated eccentric 10 of the invention is to achieve a superior stress analysis and performance over that of prior art one-piece casting eccentrics as best illustrated in the comparison graphs, FIGS. 13 and 14 which illustrate a stress to cycles for the fabricated eccentric 10 to provide a clear comparison of expected eccentric life in which the fabricated eccentric 10 of the invention is decidedly superior.

It will thus be seen that a new and novel eccentric hub formed by a multiple component fabrication process has been illustrated and described and it will be apparent to those skilled in the art that various changes and modifications may be made thereto without departing from the spirit of the invention.

Therefore I claim:

1. An eccentric assembly for a walking apparatus of a dragline excavator having a drive shaft coupled to a motor and one or more gears to rotate an eccentric assembly, the eccentric assembly comprising:

a central forged hub having a pair of oppositely disposed cylindrical lugs spaced equally from a central vertical axis passing through the center of the central forged hub, wherein the pair of oppositely disposed cylindrical lugs having a plurality of teeth protrusion splines;

the pair of oppositely disposed cylindrical lugs extending from an elliptically shaped body element tapered to form a web attachment surface;

a crescent shape web portion welded to said web attachment surface forming a central portion of the eccentric assembly;

a plurality of open circle fabricated flange elements aligning welding surfaces of the web portion, wherein a plurality of web surfaces of the web portion are inwardly directed from a perimeter edge;

an upstanding flange welded on an outer perimeter edge surface of said open circle fabricated flange elements;

a plurality of reinforcement brackets secured to at least one of the plurality of open circle fabricated flange elements and welded on to the web surfaces; and a drive shaft receiving bore coupled to the central forged hub and the pair of oppositely disposed cylindrical lugs with splined teeth fabricated therein.

2. The eccentric assembly of claim 1 wherein the pair of oppositely disposed spaced cylindrical lugs further comprise an elliptically shaped structure.

3. The elliptically shaped structure of claim 2, further having a tapered surface.

4. The eccentric assembly set forth in claim 1, wherein said upstanding flanges is curved.

5. The upstanding flanges of claim 4, wherein the upstanding flanges is fabricated from a four and a half inch thick plate.

6. The upstanding flanges of claim 4 are composed of multiple curved elements sequentially welded in end to end alignment about the outer surface of at least one of the plurality of flange elements.

7. The eccentric assembly of claim 1, wherein said reinforcement brackets are fabricated from a six inch thick steel plate.

8. The eccentric assembly of claim 1, wherein the reinforcement brackets are welded on web surfaces in oppositely disposed relation to one another.

9. The reinforcement brackets of claim 8 further comprising, a transverse aperture of a predefined diameter.

10. The reinforcement brackets of claim 8 embodied in a radial pattern.

11. The eccentric assembly of claim 1, wherein the plurality of spline teeth are engrossed on cylindrical lugs.

* * * * *